US009407005B2

(12) United States Patent
Howard et al.

(10) Patent No.: US 9,407,005 B2
(45) Date of Patent: Aug. 2, 2016

(54) ISOLATION OF POLARIZATIONS IN MULTI-POLARIZED SCANNING PHASED ARRAY ANTENNAS

(75) Inventors: John Howard, Upper Mount Bethel, NY (US); Sertac Sayin, Jersey City, NJ (US)

(73) Assignee: John Howard, Upper Mount Bethel, PA (US)

( * ) Notice: Subject to any disclaimer, the term of this patent is extended or adjusted under 35 U.S.C. 154(b) by 689 days.

(21) Appl. No.: 13/479,928

(22) Filed: May 24, 2012

(65) Prior Publication Data

US 2013/0234908 A1 Sep. 12, 2013

Related U.S. Application Data

(60) Provisional application No. 61/609,619, filed on Mar. 12, 2012.

(51) Int. Cl.

| | |
|---|---|
| ***H01Q 21/22*** | (2006.01) |
| ***H01Q 1/52*** | (2006.01) |
| ***H01Q 9/04*** | (2006.01) |
| ***H01Q 21/06*** | (2006.01) |

(52) U.S. Cl.
CPC ..... *H01Q 1/523* (2013.01); *H01Q 9/0435* (2013.01); *H01Q 21/065* (2013.01)

(58) Field of Classification Search
CPC .... H01Q 1/523; H01Q 21/065; H01Q 9/0435
See application file for complete search history.

(56) References Cited

U.S. PATENT DOCUMENTS

| | | | | |
|---|---|---|---|---|
| 7,327,317 | B2 * | 2/2008 | Heiniger | 343/700 MS |
| 2011/0001678 | A1 * | 1/2011 | Hsu et al. | 343/848 |
| 2011/0032079 | A1 * | 2/2011 | Bloy et al. | 340/10.1 |
| 2012/0306698 | A1 * | 12/2012 | Warnick et al. | 342/372 |

OTHER PUBLICATIONS

J.R. James, P.S. Hall, and C. Wood, "Microstrip Antenna-Theory and Design", The Institution of Electrical Engineers, London and New York, Peter Peregrinus Ltd., Stevenage, UK, and New York, p. 82 (1981).

P. Bhartia, K.V.S. Rao, and R.S. Tomar, "Millimeter-Wave Microstrip and Printed Circuit Antennas", Artech House, Inc., pp. 127-130 (1991).

* cited by examiner

*Primary Examiner* — Hoang V Nguyen
*Assistant Examiner* — Michael Bouizza
(74) *Attorney, Agent, or Firm* — Hoffmann & Baron, LLP

(57) ABSTRACT

A multi-polarized scanning phased array antenna includes a plurality of elements, a first feed line operatively coupling the plurality of elements, a second feed line operatively coupling the plurality of elements, and a phase delay operatively coupled in at least one of the first feed line and the second feed line. The phase delay is configured to cancel a polarized signal associated with the multi-polarized scanning phased array antenna. A method of increasing isolation between polarizations in a multi-polarized scanning phased array antenna includes coupling a plurality of elements operatively with a first feed line, coupling the plurality of elements operatively with a second feed line, and coupling a phase delay operatively in at least one of the first feed line and the second feed line such that a polarized signal associated with the multi-polarized scanning phased array antenna is cancelled.

17 Claims, 2 Drawing Sheets

ISOLATION OF POLARIZATIONS IN MULTI-POLARIZED SCANNING PHASED ARRAY ANTENNAS

CROSS-REFERENCE TO RELATED APPLICATION

This application claims the benefit of U.S. Provisional Application No. 61/609,619 filed on Mar. 12, 2012, the disclosure of which is incorporated herein by reference in its entirety.

BACKGROUND

1. Field

Embodiments of the invention generally relate to antennas and, more particularly, relate to devices and methods which increase isolation between polarizations associated with phased array antennas.

2. Related Art

One of the major challenges in antenna design is to provide the highest gain in the smallest possible area.

SUMMARY

Various embodiments of the invention relate to a device, method, and system to increase isolation between different polarizations associated with a phased array antenna. A multi-polarized scanning phased array antenna includes a plurality of elements, a horizontal feed line operatively coupled to the plurality of elements, and a vertical feed line operatively coupled to the plurality of elements.

A multi-polarized scanning phased array antenna is provided, which includes a plurality of elements, a first feed line operatively coupling the plurality of elements, a second feed line operatively coupling the plurality of elements, and a phase delay operatively coupled in at least one of the first feed line and the second feed line. The phase delay is configured to cancel a polarized signal associated with the multi-polarized scanning phased array antenna.

The plurality of elements may include a first element, second element, third element, and fourth element. A first set of elements may include the first and second elements, a second set of elements may include the third and fourth elements, a third set of elements may include the first and third elements, and a fourth set of elements may include the second and fourth elements. The phase delay may include a first phase delay operatively coupled in the first feed line between the third and fourth sets of elements, and a second phase delay operatively coupled in the second feed line between the first and second sets of elements. At least one of the first and second phase delays may include a 180° phase shift. The first, second, third, and fourth elements may be operatively coupled by the second feed line and the first feed line.

The phase delay may include a first phase delay operatively coupled in the first feed line between the third and fourth sets of elements, a second phase delay operatively coupled in the second feed line between the first and second elements, and a third phase delay operatively coupled in the second feed line between the third and fourth elements. The first phase delay may include a 180° phase shift, the second phase delay may include a 180° phase shift, and the third phase delay may include a 180° phase shift and at least one θ° phase shift, wherein θ° represents an angle of elevation scanning.

The phase delay may include a first phase delay operatively coupled in the second feed line between the first and second sets of elements, a second phase delay operatively coupled in the first feed line between the first and third elements, and a third phase delay operatively coupled in the first feed line between the second and fourth elements. The first phase delay may include a 180° phase shift, the second phase delay may include a 180° phase shift, and the third phase delay may include a 180° phase shift and at least one θ° phase shift, wherein θ° represents an angle of azimuth scanning.

The phase delay may include a first phase delay operatively coupled in the first feed line between the first and third elements, a second phase delay operatively coupled in the first feed line between the second and fourth elements, a third phase delay operatively coupled in the second feed line between the first and second elements, and a fourth phase delay operatively coupled in the second feed line between the third and fourth elements. The first phase delay may include a 180° phase shift, the second phase delay may include a 180° phase shift and at least one θ2° phase shift, the third phase delay may include a 180° phase shift, and the fourth phase delay may include a 180° phase shift and at least one θ1° phase shift, wherein θ1° represents an angle of elevation scanning and θ2° represents an angle of azimuth scanning.

The plurality of elements may include a patch antenna. The first feed line may be configured to at least one of transmit and receive at least one of a vertically polarized signal, horizontally polarized signal, right-hand clockwise circularly polarized signal, and left-hand counterclockwise circularly polarized signal. The second feed line may be configured to at least one of transmit and receive at least one of a vertically polarized signal, horizontally polarized signal, right-hand clockwise circularly polarized signal, and left-hand counterclockwise circularly polarized signal. The first feed line may be configured to be a horizontal feed line, and the second feed line may be configured to be a vertical feed line.

A method of increasing isolation between polarizations in a multi-polarized scanning phased array antenna is provided, which includes coupling a plurality of elements operatively with a first feed line, coupling the plurality of elements operatively with a second feed line, and coupling a phase delay operatively in at least one of the first feed line and the second feed line such that a polarized signal associated with the multi-polarized scanning phased array antenna is cancelled.

Coupling the phase delay may include coupling a first phase delay operatively in the first feed line between the third and fourth sets of elements, and coupling a second phase delay operatively in the second feed line between the first and second sets of elements. At least one of the first and second phase delays may include a 180° phase shift.

Coupling the phase delay may include coupling a first phase delay operatively in the first feed line between the third and fourth sets of elements, coupling a second phase delay operatively in the second feed line between the first and second elements, and coupling a third phase delay operatively in the second feed line between the third and fourth elements. The first phase delay may include a 180° phase shift, the second phase delay may include a 180° phase shift, and the third phase delay may include a 180° phase shift and at least one θ° phase shift, wherein θ° represents an angle of elevation scanning. The method may include coupling the first, second, third, and fourth elements operatively by the second feed line, and coupling the first, second, third, and fourth elements operatively by the first feed line.

Coupling the phase delay may include coupling a first phase delay operatively in the second feed line between the first and second sets of elements, coupling a second phase delay operatively in the first feed line between the first and third elements, and coupling a third phase delay operatively in the first feed line between the second and fourth elements.

The first phase delay may include a 180° phase shift, the second phase delay may include a 180° phase shift, and the third phase delay may include a 180° phase shift and at least one θ° phase shift, wherein θ° represents an angle of azimuth scanning.

Coupling the phase delay may include coupling a first phase delay operatively in the first feed line between the first and third elements, coupling a second phase delay operatively in the first feed line between the second and fourth elements, coupling a third phase delay operatively in the second feed line between the first and second elements, and coupling a fourth phase delay operatively in the second feed line between the third and fourth elements. The first phase delay may include a 180° phase shift, the second phase delay may include a 180° phase shift and at least one θ2° phase shift, the third phase delay may include a 180° phase shift, and the fourth phase delay may include a 180° phase shift and at least one θ1° phase shift, wherein θ1° represents an angle of elevation scanning and θ2° represents an angle of azimuth scanning.

The method may include configuring the first feed line to at least one of transmit and receive at least one of a vertically polarized signal, horizontally polarized signal, right-hand clockwise circularly polarized signal, and left-hand counterclockwise circularly polarized signal. The method may include configuring the second feed line to at least one of transmit and receive at least one of a vertically polarized signal, horizontally polarized signal, right-hand clockwise circularly polarized signal, and left-hand counterclockwise circularly polarized signal. The method may include configuring the first feed line to be a horizontal feed line, and configuring the second feed line to be a vertical feed line.

Other embodiments of the invention will become apparent from the following detailed description considered in conjunction with the accompanying drawings. It is to be understood, however, that the drawings are designed as an illustration only and not as a definition of the limits of any embodiments of the invention.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements that are useful or necessary in a commercially feasible embodiment are not shown in order to facilitate a less hindered view of the illustrated embodiments.

DETAILED DESCRIPTION

In the case of dual polarized antennas, such as antennas utilizing linear and circular polarization, reductions in area are achieved by introducing both polarizations in a plurality of single elements associated with the phased array or, in the case of two separate elements each having a single polarization, by providing dual polarizations that occupy the same area. To do this, the polarizations (such as vertical and horizontal) are provided by the same antenna element. However, proximity between phased array elements creates additional challenges, such as maintaining isolation between polarizations. Accordingly, embodiments of the invention improve isolation between different polarizations in multi-polarized phased array antennas. Embodiments of the invention also cancel a polarization signal while another polarization signal is active.

Figure 1:
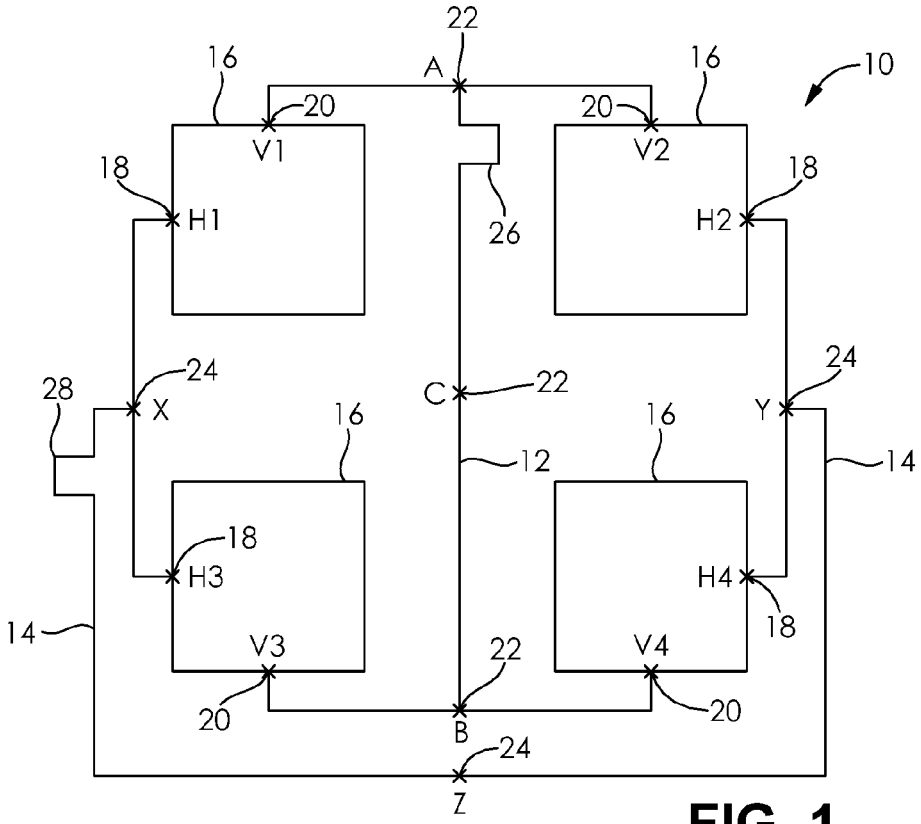
FIG. 1 shows an antenna having vertical and horizontal polarization feed lines without azimuth or elevation scanning in accordance with a first embodiment of the invention.

FIG. 1 shows an antenna 10 having vertical and horizontal polarization feed lines without azimuth or elevation scanning. The antenna 10 transmits and receives in two polarizations, such as two linear polarizations, such as vertical and horizontal polarizations. However, embodiments of the invention are equally applicable to circular polarizations. Line 12 represents a vertical polarization feed line, line 14 represents a horizontal polarization feed line, and squares represent antenna elements 16. Feed points V1, V2, V3, V4 represent vertical polarization feed points 18, and feed points H1, H2, H3, H4 represent horizontal polarization feed points 20. Connection points A, B, C represent connection points 22 for the vertical polarization feed line 12, and connection points X, Y, Z represent connection points 24 for the horizontal polarization feed line 14.

FIG. 1 shows an embodiment of the invention including a single element for dual linear polarization, which is equally applicable to all types of antennas. Signals arriving from connection point A to connection point C and connection point X to connection point Z experience an additional 180-degree phase shift 26, 28, respectively, either due to an additional length of conductor 26, 28 for a narrowband signal or a phase shifter with a 180° hybrid (not shown) for a wideband signal. That is, if the application is narrowband, such as rates up to 1.544 Mbps, the additional length of conductor is used, and if the application is wideband, such as 64 Kbps to 2 Mbps, the 180° hybrid is used. In broadband applications, the 180° phase shift can be added by using hybrids, digital phase shifters, and/or analog phase shifters.

In a first example implementation of the embodiment shown in FIG. 1, horizontal polarization is received by the vertical feed line 12. Specifically, signal V1 is fed at vertical polarization feed point V1 20 at an angle of 0°, signal V2 is fed at vertical polarization feed point V2 20 at an angle of 0°, signal V3 is fed at vertical polarization feed point V3 20 at an angle of 0°, and signal V4 is fed at vertical polarization feed point V4 20 at an angle of 0°. For normalized feed signals, V1=V2=V3=V4=1. The signal at connection point A equals V1 at 0°+V2 at 0°, and the signal at connection point B equals V3 at 0°+V4 at 0°. All four signals add at connection point C to equal V1 at 180°+V2 at 180°+V3 at 0°+V4 at 0°. Therefore, the signal at connection point C is equal to −V1 at 0°−V2 at 0°+V3 at 0°+V4 at 0°, which equals 0. Since the magnitudes of the signals are equal, the signals cancel each other, which indicate that undesirable horizontal polarization signal magnitudes become zero at connection point C. Connection point C is the output of the vertical polarization feed line while the antenna 10 is receiving. As indicated above, no horizontal polarization signal is received at connection point C. Thus, isolation is increased to infinity, which shows that one element can be used for both polarizations simultaneously without any isolation issues.

In a second example implementation of the embodiment shown in FIG. 1, vertical polarization is received by the vertical feed line 12. Specifically, signal V1 is fed at vertical polarization feed point V1 at an angle of 180°, signal V2 is fed at vertical polarization feed point V2 20 at an angle of 180°, signal V3 is fed at vertical polarization feed point V3 20 at an angle of 0°, and signal V4 is fed at vertical polarization feed point V4 20 at an angle of 0°. For normalized feed signals, V1=V2=V3=V4=1. The signal at connection point A equals V1 at 180°+V2 at 180°, and the signal at connection point B equals V3 at 0°+V4 at 0°. All four signals add at connection point C to equal V1 at 360°+V2 at 360°+V3 at 0°+V4 at 0°. Since a 360° degree phase shift is equivalent to a 0° degree phase shift, the signal at connection point C can be rewritten as V1 at 0°+V2 at 0°+V3 at 0°+V4 at 0°. This result indicates that a vertical polarization signal can be received and transmitted from the vertical feed line 12 without cancellation or degradation. Connection point C is the output of the vertical polarization feed line 12 while the antenna 10 is receiving. As indicated above, at connection point C, the vertical signal is received without cancelation or attenuation as desired while no horizontal polarization signal is received. This shows that one element can be used for both polarizations simultaneously without cancellation or attenuation issues.

In a third example implementation of the embodiment shown in FIG. 1, vertical polarization is received by the horizontal feed line 14. Specifically, signal H1 is fed at horizontal polarization feed point H1 18 at an angle of 0°, signal H2 is fed at horizontal polarization feed point H2 18 at an angle of 0°, signal H3 is fed at horizontal polarization feed point H3 18 at an angle of 0°, and signal H4 is fed at horizontal polarization feed point H4 18 at an angle of 0°. For normalized feed signals, H1=H2=H3=H4=1. The signal at connection point X equals H1 at 0°+H2 at 0°, and the signal at connection point Y equals H3 at 0°+H4 at 0°. All four signals add at connection point Z to equal H1 at 180°+H2 at 0°+H3 at 180°+H4 at 0°. Therefore, the signal at connection point Z is equal to −H1 at 0°+H2 at 0° −H3 at 0°+H4 at 0°, which equals 0. Since the magnitudes of the signals are equal, the signals cancel each other, which indicate that the magnitude of undesirable vertical polarization signals becomes zero at point Z, which is the horizontal polarization feed point. Therefore, complete isolation between polarizations is achieved in this configuration. Connection point Z is the output of the horizontal polarization feed line 14 while the antenna 10 is receiving. As indicated above, no vertical polarization signal is received at connection point Z. The isolation is increased to infinity, which indicates that one element can be used for both polarizations simultaneously without isolation issues.

In a fourth example implementation of the embodiment shown in FIG. 1, horizontal polarization is received by the horizontal feed line 14. Specifically, signal H1 is fed at horizontal polarization feed point H1 at an angle of 180°, signal H2 is fed at horizontal polarization feed point H2 at an angle of 0°, signal H3 is fed at horizontal polarization feed point H3 at an angle of 180°, and signal H4 is fed at horizontal polarization feed point H4 at an angle of 0°. For normalized feed signals, H1=H2=H3=H4=1. The signal at connection point X equals H1 at 180°+H3 at 180°, and the signal at connection point Y equals H2 at 0°+H4 at 0°. All four signals add at connection point Z to equal H1 at 360°+H2 at 0°+H3 at 360°+H4 at 0°. Since a 360° degree phase shift is equivalent to a 0° degree phase shift, the signal at point Z can be rewritten as H1 at 0°+H2 at 0°+H3 at 0°+H4 at 0°. This result indicates that a horizontal polarization signal can be received and transmitted from the horizontal feed line without cancellation or degradation. Point Z is the output of the horizontal polarization feed line 14 while the antenna 10 is receiving. As indicated above, at point Z, the horizontal signal is received without cancelation or attenuation as desired while no vertical polarization signal is received, which indicates that one element can be used for both polarizations simultaneously without cancellation or attenuation issues.

Figure 2:
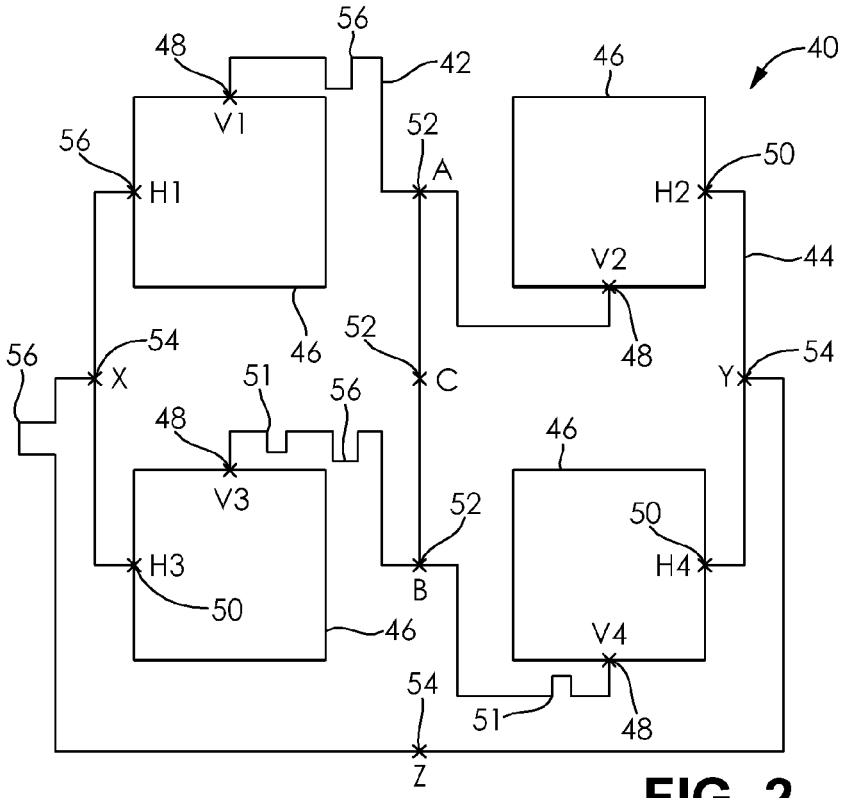
FIG. 2 shows an antenna having vertical and horizontal polarization feed lines with elevation scanning in accordance with a second embodiment of the invention.

FIG. 2 shows an antenna 40 having vertical and horizontal polarization feed lines with elevation scanning. The antenna 40 transmits and receives in two polarizations, such as in two linear polarizations, such as vertical and horizontal polarizations. However, embodiments of the invention are equally applicable to circular polarization as well. Line 42 represents a vertical polarization feed line, line 44 represents a horizontal polarization feed line, and squares represent antenna elements 46. Feed points H1, H2, H3, H4 represent horizontal polarization feed points 50, and feed points V1, V2, V3, V4 represent vertical polarization feed points 48. A, B and C represent connection points 52 for the vertical polarization feed line 42, and X, Y and Z represent connection points 54 for the horizontal polarization feed line 44.

FIG. 2 shows an embodiment of the invention including a single element for dual linear polarization, which is equally applicable to all types of antennas. Signals arriving from connection point V1 to connection point A, connection point V3 to connection point B, and connection point X to connection point Z experience an additional 180-degree phase shift either due to an additional length of conductor 56 for a narrowband signal or a phase shifter with a 180° hybrid (not shown) for wideband applications. That is, if the application is narrowband, an additional length of conductor is used, and if the application is wideband, a 180° hybrid is used. In broadband applications, the 180° phase shift can be added by using hybrids, digital phase shifters, and/or analog phase shifters. Elevation scanning is implemented by applying a θ° phase shift 51 in the vertical polarization feed line 42.

In a first example implementation of the embodiment shown in FIG. 2, horizontal polarization is received by the vertical polarization feed line 42. Specifically, signal V1 is fed at vertical polarization feed point V1 at an angle of 0°, signal V2 is fed at vertical polarization feed point V2 at an angle of 0°, signal V3 is fed at vertical polarization feed point V3 at an angle of 0°, and signal V4 is fed at vertical polarization feed point V4 at an angle of 0°. For normalized feed signals, V1=V2=V3=V4=1. The signal at connection point A equals V1 at 180°+V2 at 0° or −V1 at 0°+V2 at 0°, which is equal to 0, and the signal at connection point B equals V3 at (180+θ)°+V4 at θ° or −V3 at θ°+V4 at θ°, which equals 0. Therefore, the signal at connection point C is equal to −V1 at 0°+V2 at 0°−V3 at θ°+V4 at θ°, which equals 0. Since the magnitudes of the signals are equal, the signals cancel each other, which indicate that undesirable horizontal polarization signal magnitudes are not received by the vertical polarization feed line. Point C is the output of the vertical polarization feed line 42 while the antenna 40 is receiving. As indicated above, no horizontal polarization signal is received at connection point C. The isolation is increased to infinity, which indicates that one element can be used for both polarizations simultaneously without isolation issues.

In a second example implementation of the embodiment shown in FIG. 2, vertical polarization is received by the vertical polarization feed line 42. Specifically, signal V1 is fed at vertical polarization feed point V1 at an angle of 180°, signal V2 is fed at vertical polarization feed point V2 at an angle of 0°, signal V3 is fed at vertical polarization feed point V3 at an angle of 180°, and signal V4 is fed at vertical polarization feed point V4 at an angle of 0°. For normalized feed signals, V1=V2=V3=V4=1. The signal at connection point A equals V1 at 360°+V2 at 0° or V1 at 0°+V2 at 0°, and the signal at connection point B equals V3 at (360+θ)°+V4 at θ° or V3 at θ°+V4 at θ°. All four signals add at connection point C to equal V1 at 0°+V2 at 0°+V3 at θ°+V4 at θ°. This result indicates that a vertical polarization signal can be received and transmitted from the vertical polarization feed line 42 without cancellation or degradation. Point C is the output of the vertical polarization feed line 42 while the antenna 40 is receiving. As shown above at point C, the vertical signal is received without cancelation or attenuation as desired while no horizontal polarization signal is received, which indicates that one element can be used for both polarizations simultaneously without cancellation or attenuation issues.

In a third example implementation of the embodiment shown in FIG. 2, vertical polarization is received by the horizontal polarization feed line 44. Specifically, signal H1 is fed at horizontal polarization feed point H1 at an angle of 0°, signal H2 is fed at horizontal polarization feed point H2 at an angle of 0°, signal H3 is fed at horizontal polarization feed point H3 at an angle of θ°, and signal H4 is fed at horizontal polarization feed point H4 at an angle of θ°. For normalized feed signals, H1=H2=H3=H4=1. The signal at connection point X equals H1 at 0°+H3 at θ°, and the signal at connection point Y equals H2 at 0°+H4 at θ°. All four signals add at connection point Z to equal H1 at 180°+H2 at 0°+H3 at (180+θ)°+H4 at (180+θ)°. Therefore, the signal at connection point Z is equal to −H1 at 0°±H2 at 0°−H3 at θ°+H4 at θ°, which equals 0. Since the magnitudes of the signals are equal, the signals cancel each other, which indicates that the magnitude of undesirable vertical polarization signals become zero at connection point Z, which is the horizontal polarization feed point. Connection point Z is the output of the horizontal polarization feed line 44 while the antenna 40 is receiving. As indicated above, no vertical polarization signal is received at point Z. The isolation is increased to infinity, which shows that one element can be used for both polarizations simultaneously without isolation issues.

In a fourth example implementation of the embodiment shown in FIG. 2, horizontal polarization is received by the horizontal polarization feed line 44. Specifically, signal H1 is fed at horizontal polarization feed point H1 at an angle of 180°, signal H2 is fed at horizontal polarization feed point H2 at an angle of 0°, signal H3 is fed at horizontal polarization feed point H3 at an angle of 180°, and signal H4 is fed at horizontal polarization feed point H4 at an angle of 0°. For normalized feed signals, H1=H2=H3=H4=1. The signal at connection point X equals H1 at 180°+H3 at 180°, and the signal at connection point Y equals H2 at 0°+H4 at 0°. All four signals add at connection point Z to equal H1 at 360°+H2 at 0°+H3 at 360°+H4 at 0°. Since a 360° degree phase shift is equivalent to a 0° degree phase shift, the signal at point Z can be rewritten as H1 at 0°+H2 at 0°+H3 at 0°+H4 at 0°. This result indicates that a horizontal polarization signal can be received and transmitted from the horizontal polarization feed line 44 without cancellation or degradation. Point Z is the output of the horizontal polarization feed line 44 while the antenna 40 is receiving. As discussed above, at connection point Z, the horizontal signal is received without cancelation or attenuation as desired while no vertical polarization signal is received, which indicates that one element can be used for both polarizations simultaneously without cancellation or attenuation issues.

Figure 3:
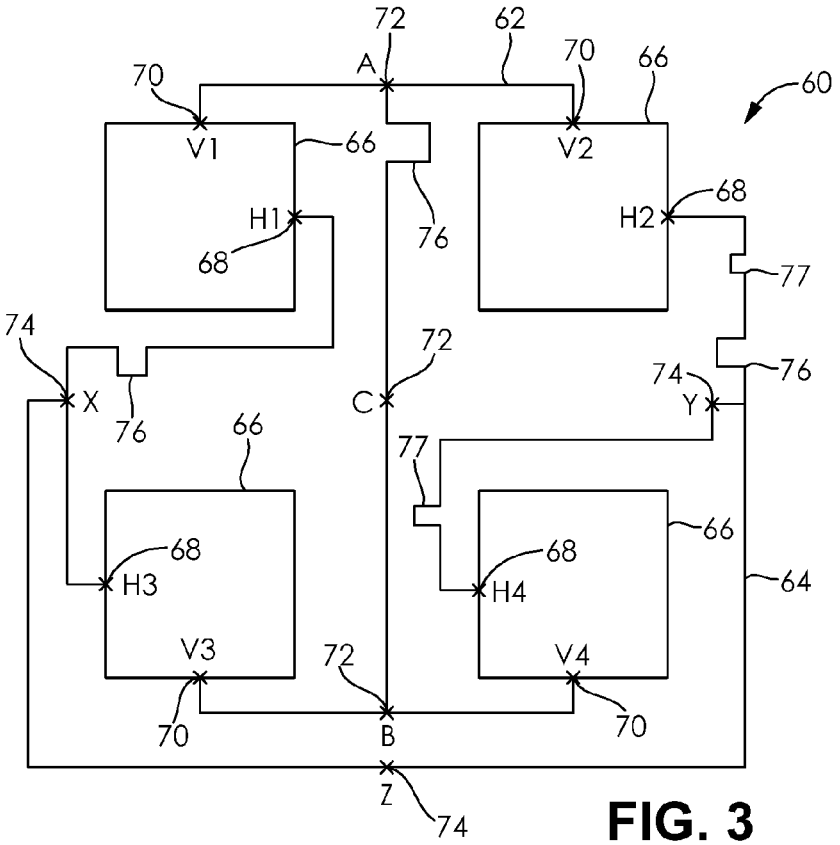
FIG. 3 shows an antenna having vertical and horizontal polarization feed lines with azimuth scanning in accordance with a third embodiment of the invention.

FIG. 3 shows an antenna 60 having vertical and horizontal polarization feed lines with azimuth scanning. The antenna 60 transmits and receives in two polarizations, such as in two linear polarizations, such as vertical and horizontal polarizations. However, embodiments of the invention are equally applicable to circular polarizations as well. Line 62 represents a vertical polarization feed line, line 64 represents a horizontal polarization feed line, and squares represent antenna elements 66. Feed points H1, H2, H3, H4 represent horizontal polarization feed points 68, and feed points V1, V2, V3, V4 represent vertical polarization feed points 70. A, B and C represent connection points 72 for the vertical polarization feed line 62, and X, Y and Z represent connection points 74 for the horizontal polarization feed line 64.

FIG. 3 shows an embodiment of the invention including a single element for dual linear polarization, which is equally applicable to all types of antennas. Signals arriving from connection point A to connection point C, connection point H1 to connection point X, and connection point H2 to connection point Y experience an additional 180-degree phase shift either due to an additional length of conductor 76 for a narrowband signal or a phase shifter with a 180° hybrid (not shown) for a wide-band signal. That is, if the application is narrowband, an additional length of conductor is used, and if the application is wideband, a 180° hybrid is used. In broadband applications, the 180° phase shift can be added by using hybrids, digital phase shifters, and/or analog phase shifters. Elevation scanning is implemented by applying a θ° phase shift 77 in the horizontal polarization feed line 64.

In a first example implementation of the embodiment shown in FIG. 3, vertical polarization is received by the horizontal polarization feed line 64. Specifically, signal H1 is fed at horizontal polarization feed point H1 at an angle of 0°, signal H2 is fed at horizontal polarization feed point H2 at an angle of 0°, signal H3 is fed at horizontal polarization feed point H3 at an angle of 0°, and signal H4 is fed at horizontal polarization feed point H4 at an angle of 0°. For normalized feed signals, H1=H2=H3=H4=1. The signal at connection point X 74 equals H1 at 180°+H3 at 0°, and the signal at connection point Y equals H2 at (180+θ)°+H4 at θ°. Therefore, since the signals differ by 180° and have the same magnitude, the signals cancel each other, which indicates that undesirable vertical polarization signal magnitudes are not received by the horizontal polarization feed line 64. Therefore, complete isolation between polarizations is achieved. Connection point Z is the output of the horizontal polarization feed line 64 while the antenna 60 is receiving. As discussed above, no vertical polarization signal is received at point Z. The isolation is increased to infinity, which indicates that one element can be used for both polarizations simultaneously without isolation issues.

In a second example implementation of the embodiment shown in FIG. 3, horizontal polarization is received by the horizontal polarization feed line 64. Specifically, signal H1 is fed at horizontal polarization feed point H1 at an angle of 180°, signal H2 is fed at horizontal polarization feed point H2 at an angle of 180°, signal H3 is fed at horizontal polarization feed point H3 at an angle of 0°, and signal H4 is fed at horizontal polarization feed point H4 at an angle of 0°. For normalized feed signals, H1=H2=H3=H4=1. The signal at connection point X equals H1 at 360°+H3 at 0° or H1 at 0°+H3 at 0°, and the signal at connection point Y equals H2 at (360+θ)°+H4 at θ° or H2 at θ°+H4 at θ°. All four signals add at connection point Z to equal H1 at 0°+H2 at 0°+H3 at θ°+H4 at θ°. This result indicates that a horizontal polarization signal can be received and transmitted from the horizontal polarization feed line 64 without any cancellation or degradation. Point Z is the output of the horizontal polarization feed line 64 while the antenna 60 is receiving. As discussed above, at point Z, the horizontal signal is received without cancelation or attenuation as desired while no vertical polarization signal is received, which shows that one element can be used for both polarizations simultaneously without cancellation or attenuation issues.

In a third example implementation of the embodiment shown in FIG. 3, horizontal polarization is received by the vertical polarization feed line 62. Specifically, signal V1 is fed at vertical polarization feed point V1 at an angle of 0°, signal V2 is fed at vertical polarization feed point V2 at an angle of θ°, signal V3 is fed at vertical polarization feed point V3 at an angle of 0°, and signal V4 is fed at vertical polarization feed point V4 at an angle of θ°. For normalized feed signals, V1=V2=V3=V4=1. The signal at connection point A equals V1 at 0°+V2 at θ°, and the signal at connection point B equals V3 at 0°+V4 at θ°. All four signals add at connection point C to equal V1 at 180°+V2 at (180+θ)°+V3 at 0°+V4 at θ°. Therefore, the signal at connection point C is equal to −V1 at 0°−V2 at θ°+V3 at θ°+V4 at θ°, which equals 0. Since the magnitudes of the signals are equal, the signals cancel each other, which indicates that the magnitude of undesirable horizontal polarization signals become zero at point C, which is the vertical polarization feed point. Point C is the output of the vertical polarization feed line 64 while the antenna 60 is receiving. As shown above, no horizontal polarization signal is received at point C. The isolation is increased to infinity, which shows that one element can be used for both polarizations simultaneously without isolation issues.

In a fourth example implementation of the embodiment shown in FIG. 3, vertical polarization is received by the vertical polarization feed line 62. Specifically, signal V1 is fed at vertical polarization feed point V1 at an angle of 180°, signal V2 is fed at vertical polarization feed point V2 at an angle of 180°, signal V3 is fed at vertical polarization feed point V3 at an angle of 0°, and signal V4 is fed at vertical polarization feed point V4 at an angle of 0°. For normalized feed signals, V1=V2=V3=V4=1. The signal at connection point A equals V1 at 180°+V2 at 180°, and the signal at connection point B equals V3 at 0°+V4 at 180°. All four signals add up at connection point C to equal V1 at 360°+V2 at 360°+V3 at 0°+V4 at 0°. Since a 360° degree phase shift is equivalent to a 0° degree phase shift, the signal at connection point C can be rewritten as V1 at 0°+V2 at 0°+V3 at 0°+V4 at 0°. This result indicates that the vertical polarization signal can be received and transmitted from the vertical polarization feed line 62 without cancellation or degradation. Point C is the output of the vertical polarization feed line 62 while the antenna 60 is receiving. As indicated above, at point C, the vertical signal is received without any cancelation or attenuation as desired while no horizontal polarization signal is received, which indicates that one element can be used for both polarizations simultaneously without cancellation or attenuation issues.

Figure 4:
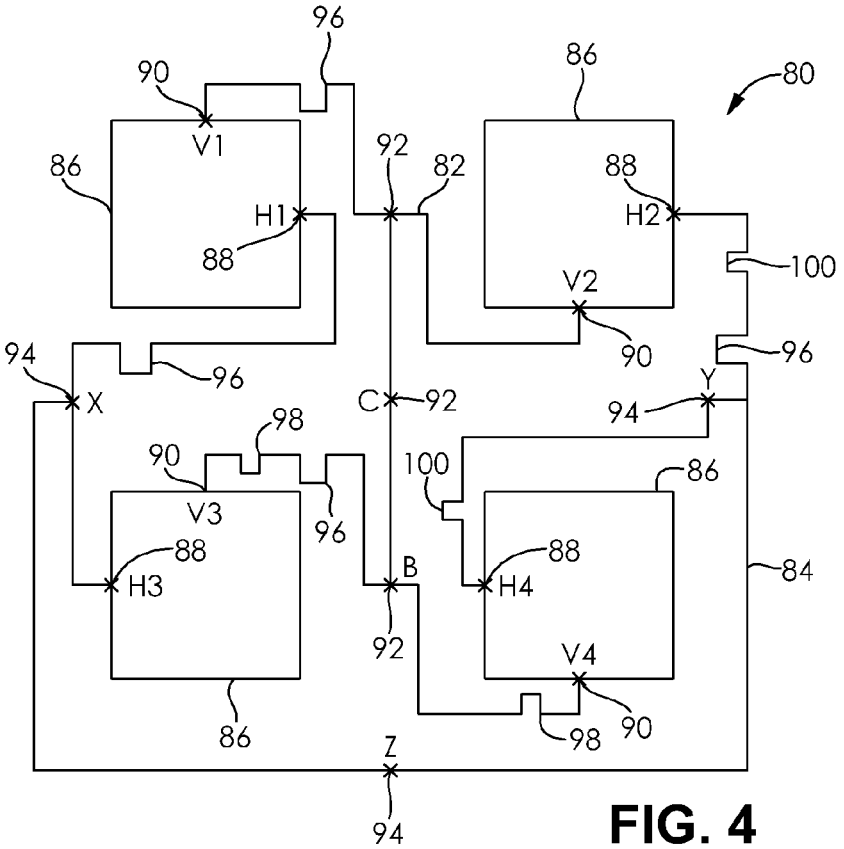
FIG. 4 shows an antenna having vertical and horizontal polarization feed lines with azimuth and elevation scanning in accordance with a fourth embodiment of the invention.

FIG. 4 shows an antenna 80 having vertical and horizontal polarization feed lines 82, 84 with azimuth and elevation scanning. The antenna 80 transmits and receives in two polarizations, such as in two linear polarizations, such as vertical and horizontal polarizations. However, embodiments of the invention are equally applicable to circular polarizations as well. Line 82 represents a vertical polarization feed line, line 84 represents a horizontal polarization feed line, and squares represent antenna elements 86. Feed points H1, H2, H3, H4 represent horizontal polarization feed points 88, and feed points V1, V2, V3, V4 represent vertical polarization feed points 90. A, B and C represent connection points 92 for the vertical polarization feed line 82, and X, Y and Z represent connection points 94 for the horizontal polarization feed line 84.

FIG. 4 shows an embodiment of the invention including a single element for dual linear polarization, which is equally applicable to all types of antennas. Signals arriving from connection point B to connection point V3, connection point A to connection point V1, and connection point H2 to connection point Y experience an additional 180-degree phase shift either due to an additional length of conductor 96 for a narrowband signal or a phase shifter with a 180° hybrid (not shown) for a wide-band signal. That is, if the application is narrowband, an additional length of conductor is used, and if application is wideband, a 180° hybrid is used. In broadband applications, the 180° phase shift can be added by using hybrids, digital phase shifters, and/or analog phase shifters. Azimuth scanning is implemented by applying a θ2° phase shift 100 in the horizontal polarization feed line 84, and elevation scanning is implemented by applying a θ1° phase shift 98 in the vertical polarization feed line 82.

To be able to steer the beam in azimuth (horizontal direction) and elevation (vertical direction), there is a phase difference between horizontal elements for azimuth steering and between vertical elements for elevation steering. FIG. 4 shows the feed line length from H2 to Y and H4 to Y is longer than from H1 to X and H3 to X, which adds the phase difference to the signal that steers the beam in azimuth. Similarly, the feed line length from V3 to B and V4 to B is longer than from V1 to A and V2 to A, which adds the phase difference to the signal that steers the beam in elevation. The additional phase may be fixed or variable. In this case, the steering angles are introduced by extra length in the feed line. However, these additional phases can also be added by digital or analog phase shifters or hybrids. These additional phase delays are referred to as θ1 phase delay 98 for elevation (vertical direction) and θ2 phase delay 100 for azimuth (horizontal direction).

In a first example implementation of the embodiment shown in FIG. 4, horizontal polarization is received by the vertical polarization feed line 82. Specifically, signal V1 is fed at vertical polarization feed point V1 at an angle of 0°, signal V2 is fed at vertical polarization feed point V2 at an angle of θ2°, signal V3 is fed at vertical polarization feed point V3 at an angle of 0°, and signal V4 is fed at vertical polarization feed point V4 at an angle of θ2°. For normalized feed signals, V1=V2=V3=V4=1. The signal at connection point A 92 equals V1 at 180°+V2 at θ2°, the signal at connection point B 92 equals V3 at (180+θ1)°+V4 at (θ1+θ2)°, and the signal at connection point C 92 equals V1 at 180°+V2 at θ2°+V3 at (180+θ1)°+V4 at (θ1+θ2)°. The magnitude of the signal in the X direction is equal to −1+cos(θ2)+cos(180+θ1)+cos (θ1+θ2), and the magnitude of the signal in the Y direction is equal to sin (θ2)+sin(180+θ1)+sin(θ1+θ2). Thus, undesirable signals are substantially attenuated by at least 6 dB. Point C is the output of the vertical polarization feed line 82 while the antenna 80 is receiving. As indicated above, no horizontal polarization signal is received at point C. The isolation is increased up to infinity, which indicates that one element can be used for both polarizations simultaneously without isolation issues.

For example, if θ1=30 and θ2=60, the magnitude of the signal in the X direction is equal to −1+cos(60)+cos(210)+cos(90), and the magnitude of the signal in the Y direction is equal to sin(60)+sin(210)+sin(90). Thus, the magnitude of the signal in the X direction equals −1.36, and the magnitude of the signal in the Y direction equals 1.36. Therefore, the magnitude of the total signal=1.92 or 5.6 dB. If the embodiment shown in FIG. 4 is not used, the magnitude of the unwanted signal at connection point C would equal 4 or 12 dB. As a result, the embodiment shown in FIG. 4 provides an improvement of 12-5.6=6.4 dB.

As another example, if θ1=60 and θ2=60, the magnitude of the signal in the X direction equals −1+cos(60)+cos(240)+cos(120), and the magnitude of the signal in the Y direction equals sin(60)+sin(240)+sin(120). Thus, the magnitude of the signal in the X direction is −1.5, and the magnitude of the signal in the Y direction is 0.86. Therefore, the magnitude of the total signal equals 1.72 or 4.7 dB. If the embodiment shown in FIG. 4 were not used, the magnitude of the unwanted signal at point C would be 4 or 12 dB. Accordingly, in this example, an improvement of 12−4.7=7.3 dB is achieved.

In a second example implementation of the embodiment shown in FIG. 4, vertical polarization is received by the vertical polarization feed line 82. Specifically, signal V1 is fed at vertical polarization feed point V1 at an angle of 180°, signal V2 is fed at vertical polarization feed point V2 at an angle of 0°, signal V3 is fed at vertical polarization feed point V3 at an angle of 180°, and signal V4 is fed at vertical polarization feed point V4 at an angle of 0°. For normalized feed signals, V1=V2=V3=V4=1. The signal at connection point A equals V1 at 360°+V2 at 0° or V1 at 0°+V2 at 0°, and the signal at connection point B equals V3 at (360+θ1)°+V4 at θ1° or V3 at θ1°+V4 at θ1°. All four signals add at connection point C to equal V1 at 0°+V2 at 0°+V3 at θ1°+V4 at θ1°. This result indicates that a vertical polarization signal can be received and transmitted from the vertical polarization feed line 82 without any cancellation or degradation. Point C is the output of the vertical polarization feed line while the antenna is receiving. As indicated above, at point C, the vertical signal is received without any cancelation or attenuation as desired while no horizontal polarization signal is received, which indicates that one element can be used for both polarizations simultaneously without cancellation or attenuation issues.

In a third example implementation of the embodiment shown in FIG. 4, vertical polarization is received by the horizontal polarization feed line 84. Specifically, signal H1 is fed at horizontal polarization feed point H1 at an angle of 0°, signal H2 is fed at horizontal polarization feed point H2 at an angle of 0°, signal H3 is fed at horizontal polarization feed point H3 at an angle of θ1°, and signal H4 is fed at horizontal polarization feed point H4 at an angle of θ1°. For normalized feed signals, H1=H2=H3=H4=1. The signal at connection point X equals H1 at 180°+H3 at θ1°, and the signal at connection point Y equals H3 at (180+θ2)°+H4 at (θ1+θ2)°. All four signals add up at connection point Z to equal H1 at 180°+H2 at (180+θ2)°+H3 at θ1°+H4 at (θ1+θ2)°. The magnitude of the signal on the X axis equals −1+cos(180+θ2)+cos(θ1)+cos(θ1+θ2), and the magnitude of the signal on the Y axis equals sin(θ1)+sin(180+θ2)+sin(θ1+θ2). This results in an attenuation of at least 6 db in the unwanted signal. The point Z is the output of the horizontal feed line while the antenna is receiving. At point Z, only horizontal polarization signal must be received while little or no vertical polarization is received. As indicated above, no vertical signal is received at point Z. The isolation is increased up to infinity. Therefore complete isolation between polarizations is achieved in this configuration, which indicates that one element can be used for both polarizations simultaneously without isolation issues.

For example, if θ1=60 and θ2=30, the magnitude of the signal in the X axes equals −1+cos(60)+cos(210)+cos(90), and the magnitude of the signal in the Y axes=sin(60)+sin(210)+sin(90). Thus, the magnitude of the signal in the X axes is −1.36, and the magnitude of the signal in the Y axes is 1.36. Therefore, the magnitude of the total signal equals 1.92 or 5.6 dB, and the magnitude of the unwanted signal at point C would be equal to 4 or 12 dB if this embodiment had not been implemented. Accordingly, in this example, a 12−5.6=6.4 dB improvement is achieved.

As another example, if θ1=60 and θ2=60, the magnitude of the signal in the X axes=−1+cos(240)+cos(60)+cos(120), and the magnitude of the signal in the Y axes=sin(60)+sin(240)+sin(120). Thus, the magnitude of the signal in the X axes is −1.5, and the magnitude of the signal in the Y axes is 0.86. Therefore, the magnitude of the total signal is 1.72 or 4.7 dB. Since the magnitude of the unwanted signal at point C would equal 4 or 12 dB without implementing this embodiment, a 12-4.7 or 7.3 dB improvement is achieved. To be able to use one element antenna for both polarizations, the isolation between two signals (vertical and horizontal) must be sufficient. In accordance with this embodiment, the isolation is improved by 7.3 dB, which indicates that one element can be used for both polarizations simultaneously.

In a fourth example implementation of the embodiment shown in FIG. 4, horizontal polarization is received by the horizontal polarization feed line 84. Specifically, signal H1 is fed at horizontal polarization feed point H1 at an angle of 180°, signal H2 is fed at horizontal polarization feed point H2 at an angle of 180°, signal H3 is fed at horizontal polarization feed point H3 at an angle of 0°, and signal H4 is fed at horizontal polarization feed point H4 at an angle of 0°. For normalized feed signals, H1=H2=H3=H4=1. The signal at connection point X equals H1 at 360°+H3 at 0° or H1 at 0°+H3 at 0°, and the signal at connection point Y equals H2 at (360+θ2)°+H4 at θ2° or H2 at θ2°+H4 at θ2°. All four signals add at connection point Z to equal H1 at 0°+H2 at 0°+H3 at θ2°+V4 at θ2°. This result indicates that the horizontal polarization signal can be received and transmitted from the horizontal polarization feed line 84 without any cancellation or degradation. Point Z is the output of the horizontal polarization feed line 84 while the antenna 80 is receiving. Only horizontal polarization signals are received at point Z while little or no vertical polarization signal is received. As shown above, at point Z, a horizontal polarization signal is received without any cancelation or attenuation as desired, which indicates that one element can be used for both polarizations simultaneously without attenuation issues.

Accordingly, embodiments of the invention provide increased isolation between polarizations in an antenna by cancelling one polarization signal while another is being used. Four different feed network embodiments are shown in FIGS. 1-4. Specifically, FIG. 1 shows an embodiment which does not implement scanning, FIG. 2 shows an embodiment implementing scanning in elevation, FIG. 3 shows an embodiment implementing scanning in azimuth, and FIG. 4 shows an embodiment implementing scanning in both elevation and azimuth. For the embodiments shown in FIGS. 1-3, complete isolation is achieved between polarizations, and the embodiment shown in FIG. 4 achieves at least a 6 db level of isolation.

Although embodiments of the invention are disclosed with four (4) elements, the invention is not limited to four (4) elements, and is equally applicable to configurations including any multiple of four (4) elements, such as eight (8), twelve (12), or sixteen (16) elements, and the like. Further, any type of element can be used while remaining within the scope of the invention. Embodiments of the invention make it possible to use one element simultaneously for two (2) polarizations. Embodiments of the invention are also applicable to phased arrays.

Although the specification describes components and functions implemented in the embodiments with reference to particular standards and protocols, the embodiment are not limited to such standards and protocols.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments of the inventive subject matter are referred to herein, individually and/or collectively, by the term "embodiment" merely for convenience and without intending to voluntarily limit the scope of this application to any single embodiment or inventive concept if more than one is in fact shown. Thus, although specific embodiments have been illustrated and described herein, it should be appreciated that any arrangement calculated to achieve the same purpose are substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus the following claims are hereby incorporated into the detailed description, with each claim standing on its own as a separate example embodiment.

The abstract is provided to comply with 37 C.F.R. §1.72(b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings of the invention provided herein, one of ordinary skill in the art will be able to contemplate other implementations and applications of the techniques of the invention. Although illustrative embodiments of the invention have been described herein with reference to the accompanying drawings, it is to be understood that the invention is not limited to those precise embodiments, and that various other changes and modifications are made therein by one skilled in the art without departing from the scope of the appended claims.

What is claimed is:

1. A multi-polarized scanning phased array antenna, which comprises:

a plurality of elements, the plurality of elements comprising a first element and a second element, the first element being fed with a first polarization signal at a first angle and a second polarization signal at a second angle, the second element being fed with the first polarization signal at a third angle and the second polarization signal at a fourth angle, the first polarization signal comprising a first polarization, the second polarization signal comprising a second polarization, the first polarization being different from the second polarization;

a first feed line operatively coupling the plurality of elements, the first feed line being bent using only first angles, the first angles being only right angles, the first feed line being associated with the first polarization;

a second feed line operatively coupling the plurality of elements, the second feed line being bent using only second angles, the second angles being only right angles, the second feed line being associated with the second polarization; and at least one phase shifter operatively coupled in at least one of the first feed line and the second feed line, one of the first polarization signal and the second polarization signal being cancelled at a connection point between the first and second elements by operation of the at least one phase shifter and at least one of the first, second, third, and fourth angles, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, the at least one phase shifter providing a 180° phase shift between at least one of (1) the first and third angles and (2) the second and fourth angles.

2. The multi-polarized scanning phased array antenna, as defined by claim 1, wherein the plurality of elements comprises a patch antenna.

3. The multi-polarized scanning phased array antenna, as defined by claim 1, wherein the first feed line at least one of transmits and receives at least one of a vertically polarized signal, horizontally polarized signal, right-hand clockwise circularly polarized signal, and left-hand counterclockwise circularly polarized signal.

4. The multi-polarized scanning phased array antenna, as defined by claim 1, wherein the second feed line at least one of transmits and receives at least one of a vertically polarized signal, horizontally polarized signal, right-hand clockwise circularly polarized signal, and left-hand counterclockwise circularly polarized signal.

5. The multi-polarized scanning phased array antenna, as defined by claim 1, wherein the first feed line is a horizontally polarized feed line, the second feed line being vertically polarized feed line.

6. A multi-polarized scanning phased array antenna, which comprises:

a plurality of elements, the plurality of elements comprising a first element, a second element, a third element, and a fourth element, the first element being fed with a first polarization signal at a first angle and a second polarization signal at a second angle, the second element being fed with the first polarization signal at a third angle and the second polarization signal at a fourth angle, the third element being fed with the first polarization signal at a fifth angle and the second polarization signal at a sixth angle, the fourth element being fed with the first polarization signal at a seventh angle and the second polarization signal at an eighth angle, the first polarization signal comprising a first polarization, the second polarization signal comprising a second polarization, the first polarization being different from the second polarization;

a first feed line operatively coupling the plurality of elements, the first feed line being bent using only first angles, the first angles being only right angles, the first feed line being associated with the first polarization;

a second feed line operatively coupling the plurality of elements, the second feed line being bent using only second angles, the second angles being only right angles, the second feed line being associated with the second polarization; and at least one phase shifter operatively coupled in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, the at least one phase shifter comprising:

a first phase shifter operatively coupled in the first feed line between the third and fourth sets of elements, the first phase shifter providing 180° phase shift between the first and seventh angles; and a second phase shifter operatively coupled in the second feed line between the first and second sets of elements, the second phase shifter providing 180° phase shift between the second and eighth angles.

7. A multi-polarized scanning phased array antenna, which comprises:

a plurality of elements, the plurality of elements comprising a first element, a second element, a third element, and a fourth element, the first element being fed with a first polarization signal at a first angle and a second polarization signal at a second angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

a first feed line operatively coupling the plurality of elements, the first feed line being bent using only first angles, the first angles being only right angles, the first feed line being associated with the first polarization;

a second feed line operatively coupling the plurality of elements, the second feed line being bent using only second angles, the second angles being only right angles, the second feed line being associated with the second polarization; and at least one phase shifter operatively coupled in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, the at least one phase shifter further comprising:

a first phase shifter operatively coupled in the first feed line between the third and fourth sets of elements, the first phase shifter providing 180° phase shift between the first and seventh angles;

a second phase shifter operatively coupled in the second feed line between the first and second elements, the second phase shifter providing 180° phase shift between the second and fourth angles; and a third phase shifter operatively coupled in the second feed line between the third and fourth elements, the third phase shifter providing 180° phase shift and at least one θ° phase shift between the sixth and eighth angles, θ° representing an angle of elevation scanning, the phased array antenna performing elevation scanning based on θ°.

8. A multi-polarized scanning phased array antenna, which comprises:

a plurality of elements, the plurality of elements comprising a first element, a second element, a third element, and a fourth element, the first element being fed with a first polarization signal at a first angle and a second polarization signal at a second angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

a first feed line operatively coupling the plurality of elements, the first feed line being bent using only first angles, the first angles being only right angles, the first feed line being associated with the first polarization;

a second feed line operatively coupling the plurality of elements, the second feed line being bent using only second angles, the second angles being only right angles, the second feed line being associated with the second polarization; and at least one phase shifter operatively coupled in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, the at least one phase shifter comprising:

a first phase shifter operatively coupled in the second feed line between the first and second sets of elements, the first phase shifter providing 180° phase shift between the second and eighth angles;

a second phase shifter operatively coupled in the first feed line between the first and third elements, the second phase shifter providing 180° phase shift between the first and fifth angles; and a third phase shifter operatively coupled in the first feed line between the second and fourth elements, the third phase shifter providing 180° phase shift and at least one θ° phase shift between the third and seventh angles, θ° representing an angle of azimuth scanning, the phased array antenna performing azimuth scanning based on θ°.

9. A multi-polarized scanning phased array antenna, which comprises:

a plurality of elements, the plurality of elements comprising a first element, a second element, a third element, and a fourth element, the first element being fed with a first polarization signal at a first angle and a second polarization signal at a second angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

a first feed line operatively coupling the plurality of elements, the first feed line being bent using only first angles, the first angles being only right angles, the first feed line being associated with the first polarization;

a second feed line operatively coupling the plurality of elements, the second feed line being bent using only second angles, the second angles being only right angles, the second feed line being associated with the second polarization; and at least one phase shifter operatively coupled in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization being cancelled at a connection point between at least one of (1) the third and fourth sets of elements and (2) the first and second sets of elements by operation of the at least one phase shifter and on at least one of the first, second, third, fourth, fifth, sixth, seventh, and eighth angles, the at least one phase shifter comprising:

a first phase shifter operatively coupled in the first feed line between the first and third elements, the first phase shifter providing 180° phase shift between the first and fifth angles;

a second phase shifter operatively coupled in the first feed line between the second and fourth elements, the second phase shifter providing 180° phase shift and at least one $\theta_2$° phase shift between the third and seventh angles, $\theta_2$° representing an angle of azimuth scanning, the phased array antenna performing azimuth scanning based on $\theta_2$°;

a third phase shifter operatively coupled in the second feed line between the first and second elements, the third phase shifter providing 180° phase shift between the second and fourth angles; and a fourth phase shifter operatively coupled in the second feed line between the third and fourth elements, the fourth phase shifter providing 180° phase shift and at least one $\theta_1$° phase shift between the sixth and eighth angles, $\theta_1$° representing an angle of elevation scanning, the phased array antenna performing elevation scanning based on $\theta_1$°.

10. A method of increasing isolation between polarizations in a multi-polarized scanning phased array antenna, which comprises:

coupling a plurality of elements operatively with a first feed line, the first feed line being bent using only first angles, the first angles being only right angles, the plurality of elements comprising a first element and a second element, the first element being fed with a first polarization signal at a first angle and a second polarization signal at a second angle, the second element being fed with the first polarization signal at a third angle and the second polarization signal at a fourth angle, the first polarization signal comprising a first polarization, the second polarization signal comprising a second polarization, the first polarization being different from the second polarization;

coupling the plurality of elements operatively with a second feed line, the second feed line being bent using only second angles, the second angles being only right angles, the first feed line being associated with the first polarization, the second feed line being associated with the second polarization; and coupling at least one phase shifter operatively in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, the at least one phase shifter providing a 180° phase shift between at least one of (1) the first and third angles and (2) the second and fourth angles.

11. The method, as defined by claim 10, further comprising configuring the first feed line to at least one of transmit and receive at least one of a vertically polarized signal, horizontally polarized signal, right-hand clockwise circularly polarized signal, and left-hand counterclockwise circularly polarized signal.

12. The method, as defined by claim 10, further comprising configuring the second feed line to at least one of transmit and receive at least one of a vertically polarized signal, horizontally polarized signal, right-hand clockwise circularly polarized signal, and left-hand counterclockwise circularly polarized signal.

13. The method, as defined by claim 10, further comprising:

configuring the first feed line to be a horizontally polarized feed line; and configuring the second feed line to be a vertically polarized feed line.

14. A method of increasing isolation between polarizations in a multi-polarized scanning phased array antenna, which comprises:

coupling a plurality of elements operatively with a first feed line, the plurality of elements comprising a first element, a second element, a third element, and a fourth element, the first element being fed with a first polarization signal at a first angle and a second polarization signal at a second angle, the second element being fed with the first polarization signal at a third angle and the second polarization signal at a fourth angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

coupling the plurality of elements operatively with a first feed line, the first feed line being bent using only first angles, the first angles being only right angles, the first feed line being associated with the first polarization;

coupling the plurality of elements operatively with a second feed line, the second feed line being bent using only second angles, the second angles being only right angles, the second feed line being associated with the second polarization; and coupling at least one phase shifter operatively in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, coupling the at least one phase shifter comprising:

coupling a first phase shifter operatively in the first feed line between the third and fourth sets of elements, the first phase shifter providing 180° phase shift between the first and seventh angles; and coupling a second phase shifter operatively in the second feed line between the first and second sets of elements, the second phase shifter providing 180° phase shift between the second and eighth angles.

15. A method of increasing isolation between polarizations in a multi-polarized scanning phased array antenna, which comprises:

coupling a plurality of elements operatively with a first feed line, the plurality of elements comprising a first element, a second element, a third element, and a fourth element, the first element being fed with a first polarization signal at a first angle and a second polarization signal at a second angle, the second element being fed with the first polarization signal at a third angle and the second polarization signal at a fourth angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

coupling the plurality of elements operatively with a first feed line, the first feed line being bent using only first angles, the first angles being only right angles, the first feed line being associated with the first polarization;

coupling the plurality of elements operative with a second feed line, the second feed line being bent using only second angles, the second angles being only right angles, the second feed line being associated with the second polarization; and coupling at least one phase shifter operatively in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, coupling the at least one phase shifter comprising:

coupling a first phase shifter operatively in the first feed line between the third and fourth sets of elements, the first phase shifter providing 180° phase shift between the first and seventh angles;

coupling a second phase shifter operatively in the second feed line between the first and second elements, the second phase shifter providing 180° phase shift between the second and fourth angles;

coupling a third phase shifter operatively in the second feed line between the third and fourth elements, the third phase shifter providing 180° phase shift and at least one θ° phase shift between the sixth and eighth angles, θ° representing an angle of elevation scanning; and performing elevation scanning based on θ°.

16. A method of increasing isolation between polarizations in a multi-polarized scanning phased array antenna, which comprises:

coupling a plurality of elements operatively with a first feed line, the plurality of elements comprising a first element, a second element, a third element, and a fourth element, the first element being fed with a first polarization signal at a first angle and a second polarization signal at a second angle, the second element being fed with the first polarization signal at a third angle and the second polarization signal at a fourth angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

coupling the plurality of elements operatively with a first feed line, the first feed line being bent using only first angles, the first angles being only right angles, the first feed line being associated with the first polarization;

coupling the plurality of elements operatively with a second feed line, the second feed line being bent using only second angles, the second angles being only right angles, the second feed line being associated with the second polarization; and coupling at least one phase shifter operatively in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, coupling the at least one phase shifter comprising:

coupling a first phase shifter operatively in the second feed line between the first and second sets of elements, the first phase shifter providing 180° phase shift between the second and eighth angles;

coupling a second phase shifter operatively in the first feed line between the first and third elements, the second phase shifter providing 180° phase shift between the first and fifth angles;

coupling a third phase shifter operatively in the first feed line between the second and fourth elements, the third phase shifter providing 180° phase shift and at least one θ° phase shift between the third and seventh angles, θ° representing an angle of azimuth scanning; and performing azimuth scanning based on θ°.

17. A method of increasing isolation between polarizations in a multi-polarized scanning phased array antenna, which comprises:

coupling a plurality of elements operatively with a first feed line, the plurality of elements comprising a first element, a second element, a third element, and a fourth element, the first element being fed with a first polarization signal at a first angle and a second polarization signal at a second angle, the second element being fed with the first polarization signal at a third angle and the second polarization signal at a fourth angle, the third element being fed with the first polarization signal at a fifth angle and the second polarization signal at a sixth angle, the fourth element being fed with the first polarization signal at a seventh angle and the second polarization signal at an eighth angle, the second element being fed with the first polarization signal at a third angle and the second polarization signal at a fourth angle, the first polarization signal comprising a first polarization, the second polarization signal comprising a second polarization, the first polarization being different from the second polarization;

coupling the plurality of elements operatively with a first feed line, the first feed line being bent using only first angles, the first angles being only right angles, the first feed line being associated with the first polarization;

coupling the plurality of elements operatively with a second feed line, the second feed line being bent using only second angles, the second angles being only right angles, the second feed line being associated with the second polarization; and coupling at least one phase shifter operatively in at least one of the first feed line and the second feed line, the at least one phase shifter comprising at least one of a digital phase shifter and an analog phase shifter, the analog phase shifter comprising at least one length of conductor in addition to that required to couple the plurality of elements across the analog phase shifter using a straight conductor, the at least one length of conductor providing a phase shift, a first set of elements comprising the first and second elements, a second set of elements comprising the third and fourth elements, a third set of elements comprising the first and third elements, a fourth set of elements comprising the second and fourth elements, one of the first polarization signal and the second polarization signal being cancelled at a connection point between at least one of (1) the third and fourth sets of elements and (2) the first and second sets of elements by operation of the at least one phase shifter and at least one of the first, second, third, fourth, fifth, sixth, seventh, and eighth angles, coupling the at least one phase shifter comprising:

coupling a first phase shifter operatively in the first feed line between the first and third elements, the first phase shifter providing 180° phase shift between the first and fifth angles;

coupling a second phase shifter operatively in the first feed line between the second and fourth elements, the second phase shifter providing 180° phase shift and at least one $\theta_2°$ phase shift between the third and seventh angles, $\theta_2°$ representing an angle of azimuth scanning;

performing azimuth scanning based on $\theta_2°$;

coupling a third phase shifter operatively in the second feed line between the first and second elements, the third phase shifter providing 180° phase shift between the second and fourth angles; and coupling a fourth phase shifter operatively in the second feed line between the third and fourth elements, the fourth phase shifter providing 180° phase shift and at least one $\theta_1°$ phase shift between the sixth and eighth angles, $\theta_1°$ representing an angle of elevation scanning and; performing elevation scanning based on $\theta_1°$.

* * * * *